US005984024A

United States Patent [19]

Strand

[11] Patent Number: 5,984,024

[45] Date of Patent: Nov. 16, 1999

[54] CUTTER, A STOPPER MEANS AND A METHOD OF PREVENTING MUD FROM ENTERING INTO A CUTTER

[75] Inventor: Göran Strand, Sandviken, Sweden

[73] Assignee: Sandvik AB, Sandviken, Sweden

[21] Appl. No.: 08/973,976

[22] PCT Filed: Jun. 12, 1996

[86] PCT No.: PCT/SE96/00761

§ 371 Date: Apr. 22, 1998

§ 102(e) Date: Apr. 22, 1998

[87] PCT Pub. No.: WO97/01016

PCT Pub. Date: Jan. 9, 1997

[30] Foreign Application Priority Data

Jun. 22, 1995 [SE] Sweden ..... 9502277

[51] Int. Cl.[6] ..... E21B 10/24

[52] U.S. Cl. ..... 175/57; 175/227; 175/228

[58] Field of Search ..... 175/227, 228, 175/229, 337, 371

[56] References Cited

U.S. PATENT DOCUMENTS

| | | | |
|---|---|---|---|
| 1,444,074 | 2/1923 | Hughes et al. . | |
| 4,167,219 | 9/1979 | McQueen | 175/229 |
| 4,448,271 | 5/1984 | Persson . | |
| 5,477,934 | 12/1995 | Strand | 175/227 |
| 5,839,523 | 11/1998 | Brolound | 175/228 |

FOREIGN PATENT DOCUMENTS

| | | |
|---|---|---|
| 2742019 | 3/1979 | Germany . |
| 501854 | 6/1995 | Sweden . |

*Primary Examiner*—William Neuder
*Assistant Examiner*—Chi H. Kang
*Attorney, Agent, or Firm*—Burns, Doane, Swecker & Mathis, L.L.P.

[57] ABSTRACT

The present invention relates to a cutter for a raise boring head. The cutter is rotatable about a center axis and mounted, via a shaft of the cutter, in a saddle secured to the raise boring head. The shaft has ends that are secured to the saddle by a fastening mechanism. Bearings are provided between the shaft and a hub of the cutter in order to make it possible for the hub to rotate relative to the shaft. Seals are provided between the shaft and the hub, and the bore which is provided for introducing lubrication into the interior of the cutter. An expansion plug is mounted in the bore. The expansion plug is designed to accommodate the lubrication that enters into the bore from the bearings. A stopper is provided in the bore. The stopper encases a part of the fastening mechanism and is arranged to prevent mud from entering the orifice of the bore.

10 Claims, 4 Drawing Sheets

CUTTER, A STOPPER MEANS AND A METHOD OF PREVENTING MUD FROM ENTERING INTO A CUTTER

TECHNICAL BACKGROUND

The present invention relates to a cutter for a raise boring head. The cutter is rotatable about a center axis and mounted, via a shaft of the cutter, in a saddle secured to the raise boring head. The shaft has ends that are secured to the saddle by fastening means. Bearing means are provided between the shaft and a hub of the cutter in order to make it possible for the hub to rotate relative to the shaft. Sealing means between the shaft and the hub, and bore/hole means for introducing lubrication means into the interior of the cutter are provided. An expansion plug is mounted in the bore means. The expansion plug is designed to accommodate lubrication means that enters into the bore means from the bearing means. A stopper means is provided in the bore means. The invention further relates to a stopper means and a method of preventing mud from entering into a cutter.

When cutters of the type mentioned above are working it is necessary that the bearing means are embedded in a lubricant, preferably grease, i.e. the space between the shaft and the cutter is filled with grease. This is done in order to minimize the friction when the hub is rotated relative to the shaft. By having a low internal friction in the bearing means the life of the cutter is kept at an acceptable level. When the cutter is subjected to a heavy load, much heat is generated when the hub is rotated relative to the shaft and by friction when the cutter works the rock. Due to the heat generation the grease expands and the internal pressure of the cutter rises. Under such conditions it occasionally happens that the internal pressure of the cutter reaches a level where the sealing means are not able to withstand said internal pressure, i.e. the sealing means collapses and the grease emerges from the bearing means. It is readily understood that if the sealing means collapses then the cutter will rapidly break down.

In our SE-B-501 854 a cutter for a reaming head is provided with means to avoid the above-mentioned drawbacks. Said reference is incorporated in the present description by reference. However, it has turned out that during normal generally dry working conditions, mud has a tendency to clog the exit to the outside of the cutter. The clogged mud assume properties similar to concrete. This means that the escape route of the grease becomes blocked and that regreasing has to be preceded by a thorough cleaning in order to facilitate dismounting of a retainer plug.

In our U.S. Pat. No. 4,448,271 a mounting system for a saddle is described to which the present invention relates.

OBJECTS OF THE INVENTION

An object of the present invention is to present a device for a cutter that stops the mud from entering into a central bore in the cutter thereby maintaining open channels for grease to expand through.

Another object of the present invention is to present a device for a cutter that facilitates removal of the retainer plug before regreasing.

The objects of the present invention are realized by a device for a cutter that has been given the characteristics of the appending claims.

DESCRIPTION OF THE DRAWINGS

Below an embodiment of the device for the cutter according to the present invention is described, reference being made to the accompanying drawings, wherein.

DETAILED DESCRIPTION OF THE INVENTION

Figure 1:
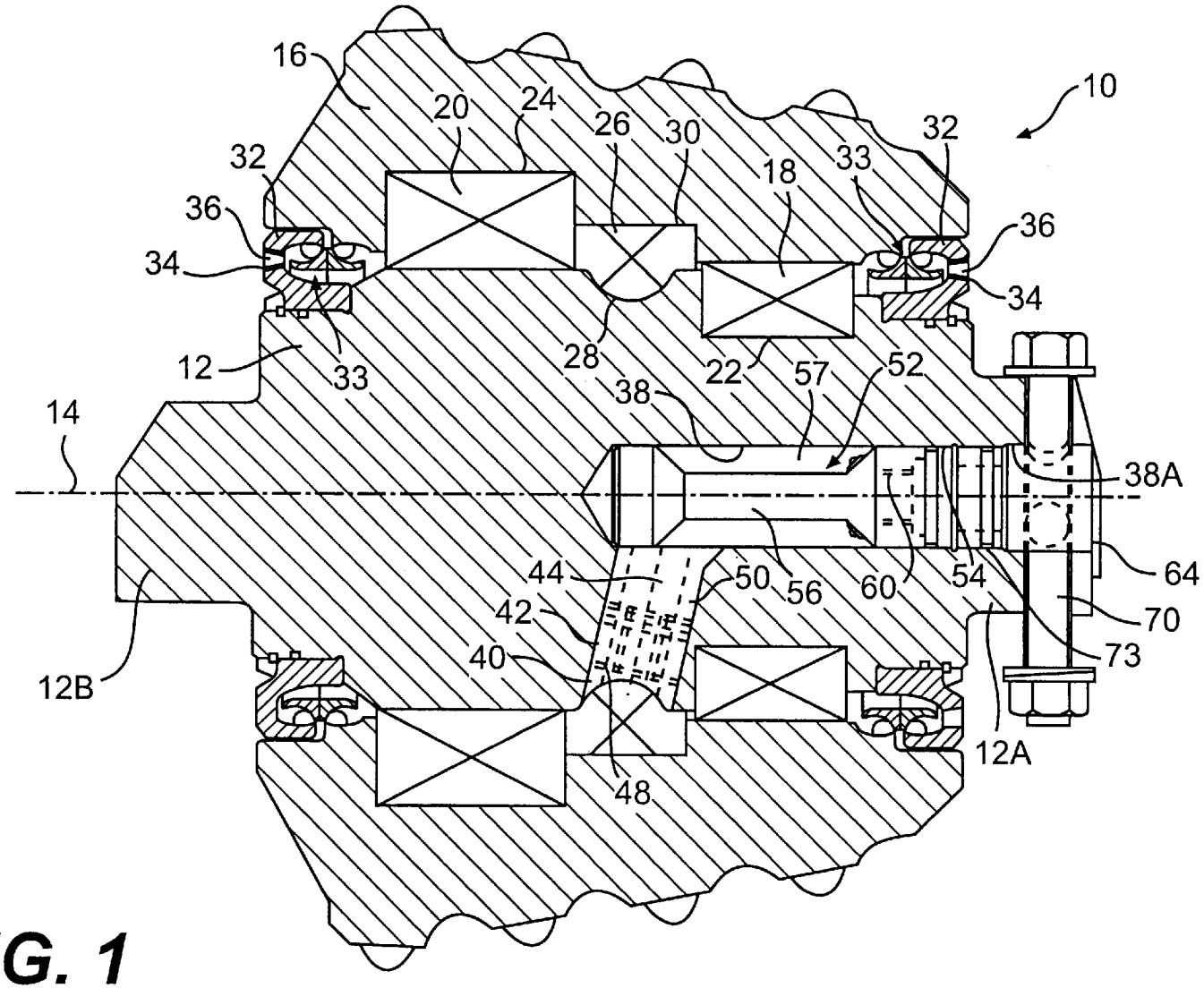
FIG. 1 shows a section through a cutter when the cutter is in working condition.
Figure 3:
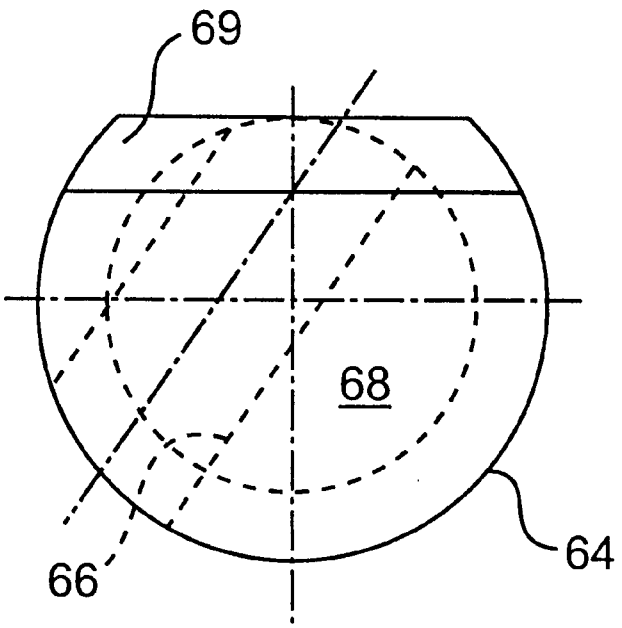
FIGS. 2 and 3 show the device according to the present invention in side and front views, respectively and FIG. 4 show an enlarged cross section according to FIG. 1.
Figure 2:
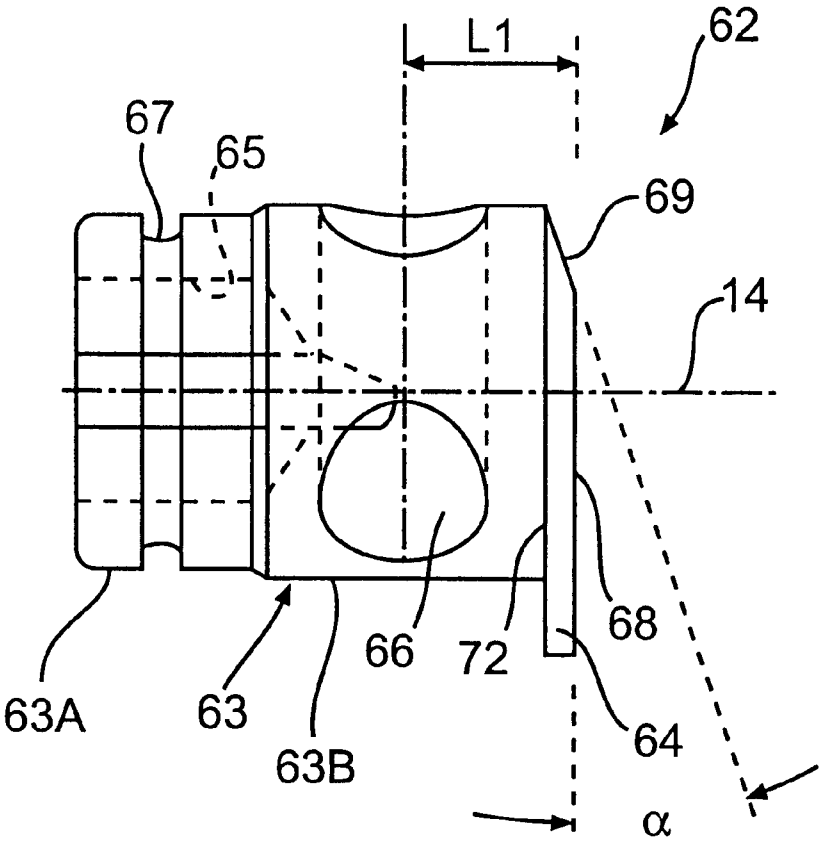

The cutter 10 according to FIGS. 1 and 2 includes a shaft 12 having a longitudinal centre axis 14. The shaft 12 is mounted in a saddle (not shown) via the ends 12A, 12B. The saddle is secured to the boring head (not shown). A hub 16 is rotatably mounted on the shaft 12 via bearing means 18 and 20, respectively. The bearing means 18 is received in a first tangential, circumferential groove 22 in the shaft 12 while the bearing means 20 is received in a second tangential, circumferential groove 24 in the hub 16. The hub 16 is locked axially relative to the shaft 12 by locking means 26, preferably in the shape of balls, that cooperate with third and fourth tangential, circumferential grooves 28 and 30, respectively, in both the shaft 12 and the hub 16.

Between the axial ends of the hub 16 and the shaft 12 the cutter 10 is at both ends provided with seal retainer means 32 supporting sealing means 33 that prevents the lubricant, such as grease or oil, from leaking out from the interior of the cutter 10. Both seal retainer means 32 are equipped with first relief holes 34 having conical plugs 36 mounted in said holes 34 to prevent grease from leaking out through said holes 34. The function of the first relief holes 34 is explained more in detail below.

Figure 4:
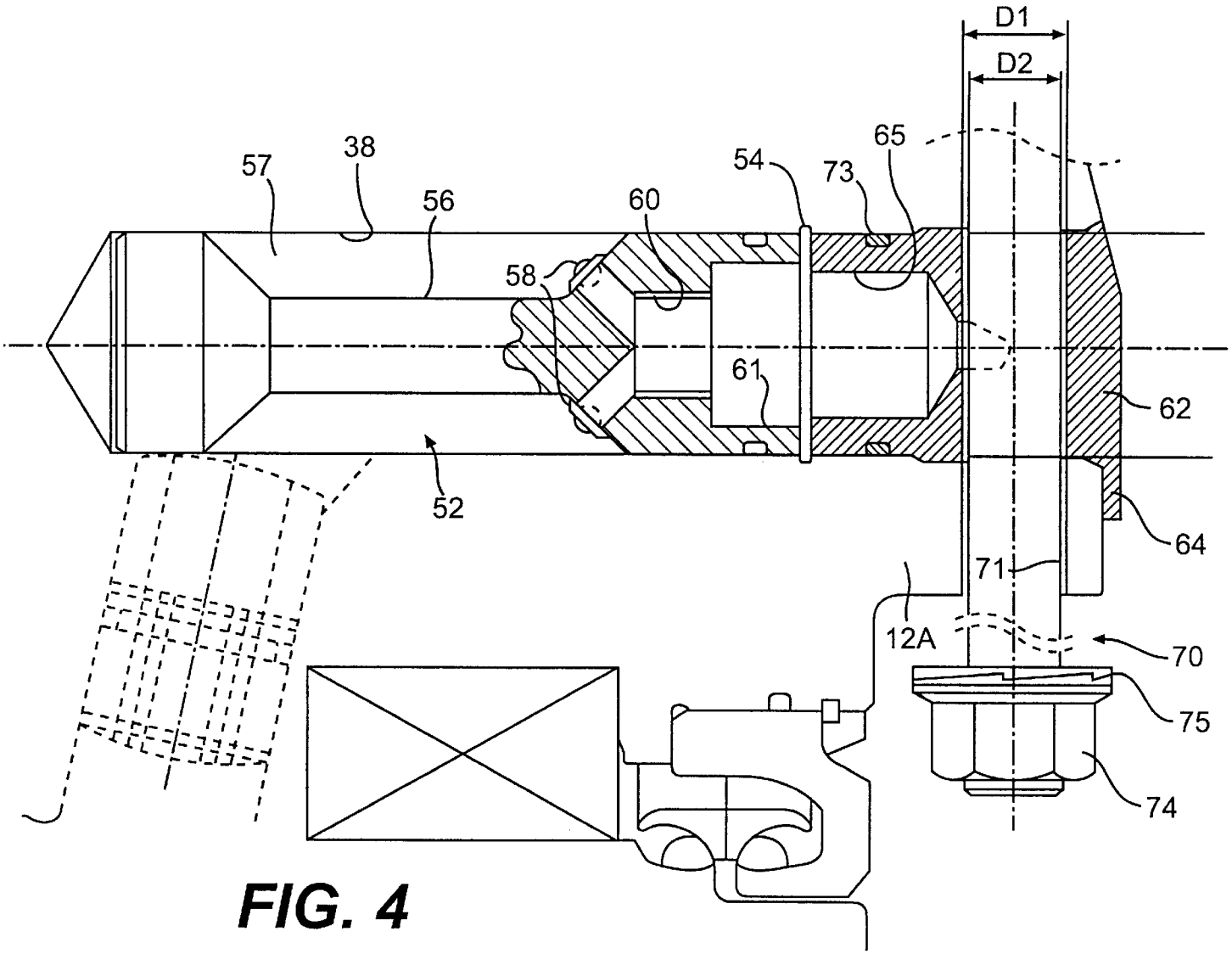

The cutter 10 according to FIGS. 1 and 4 is provided with an axial bore 38 that extends from one end 12A of the shaft 12, i.e. in the disclosed embodiment from the end of the shaft 12 where the hub 16 has its smallest diameter. The axial bore 38 has an extension about halfway of the length of the shaft 12. The outer end of the bore 38 close to the shaft end 12A has a first portion 38A of somewhat larger diameter than the rest of the bore. Close to the inner end of the bore 38 a generally radial bore 40 extends from the axial bore 38 to the third groove 28. Said bore 40 is used to mount the balls of the locking means 26. When the balls have been mounted a ball plug 42 and a spacer plug 44 are mounted in the bore 40, said plugs 42 and 44 together extending between the balls of the locking means 26 and a filling plug that is mounted in the axial bore 38 by slide fit. The filling plug and the greasing procedure is more clearly described in our SE-B-501 854 which is incorporated into the present description by reference.

The ball plug 42 is provided with two axially extending holes 48 offset from the longitudinal centre axis of the ball plug 42 while the spacer plug 44 is provided with one axially extending central hole 50. The reason why the holes 48 of the ball plug 42 are offset is that the area of contact between the balls of the locking means 26 and the ball plug should not prevent grease from entering into the locking means 26 and further to the bearing means 18,20.

The filling plug is removed after greasing and replaced by an expansion plug 52, that has a shorter length compared to the filling plug. The expansion plug is mounted via slide fit. However, the expansion plug 52 is secured against axial displacement outwardly by a snap ring 54. The expansion plug 52 has an intermediate portion 56 with reduced diameter and consequently a circumferential expansion space 57 is provided between the reduced portion 56 and the wall of the bore 38. At its front end the expansion plug 52 bears against the bottom of the radial bore 38. At its rear end the expansion plug 52 is provided with pressure relief valves 58 that are connected to a first central recess 60. The recess 60 is threaded to facilitate insertion and removal of the plug 52 into or out of the bore 38. Preferably the thread is of dimension M24. The recess 60 is further connected to a second central recess 61 which is open towards the outer end of the plug 52.

A stopper or a cap 62 covers the outer end of the plug 52 in order to prevent the valves 58 and the bore 38 from being clogged by cuttings or dirt. The cap 62 comprises a generally cylindrical shank portion 63 and a flange portion 64. The shank portion 63 has a third central recess 65 open towards the free end of a first shank portion 63A which is open towards the second recess 61 of the plug 52. The third recess 65 is connected to a through-going first hole 66 which traverses the cap 62 substantially perpendicular to the center axis 14 in a second shank portion 63B. The center line of the hole 66 extends eccentrically relative to the center axis 14, i.e. the center line of the hole 66 does not intersect the center axis 14. The hole 66 has a diameter D1 and is positioned a distance L1 from a substantially planar front face 68 of the cap 62. The diameter D1 is about 18 mm and the distance L1 is about 18 mm. The front face 68 preferably is perpendicular to the center axis 14 and plane parallel with an opposed rear surface 72. The diameter of the second shank portion 63B is larger than the diameter of the first shank portion 63A. The cap has a groove 67 extending tangentially along the envelope surface of the shank portion suitably radially outside the recess 65. The groove 67 is adapted to hold an O-ring 73 which seals off the bore 38 from dirt and which positions the cap 62 during mounting. The flange portion 64 extends substantially perpendicular to the center axis 14 and has a substantially semi-circular basic shape. The flange 64 covers the orifice of the bore 38A. A substantially planar bevel 69 cuts through the flange 64 and connects to the front face 68 at an acute angle $\alpha$. The angle $\alpha$ is about 15°. The bevel 69 is provided to lie flush with a bevel of the surrounding shank end 12A thereby leaving extra space during handling of the cutter 10.

A cutter bolt or screw 70 is provided to be inserted through a second hole 71 in the shank end 12A and through the first hole 66 and further into a threaded bore (not shown) in the saddle end 12A. The screw has a diameter D2 which is 5 to 20%, preferably about 10%, smaller than the hole 66 diameter D1 and the diameter of the second hole 71 so as to create a gap therebetween. The gap will function as a grease channel towards the exterior of the cutter 10.

Figure 5:
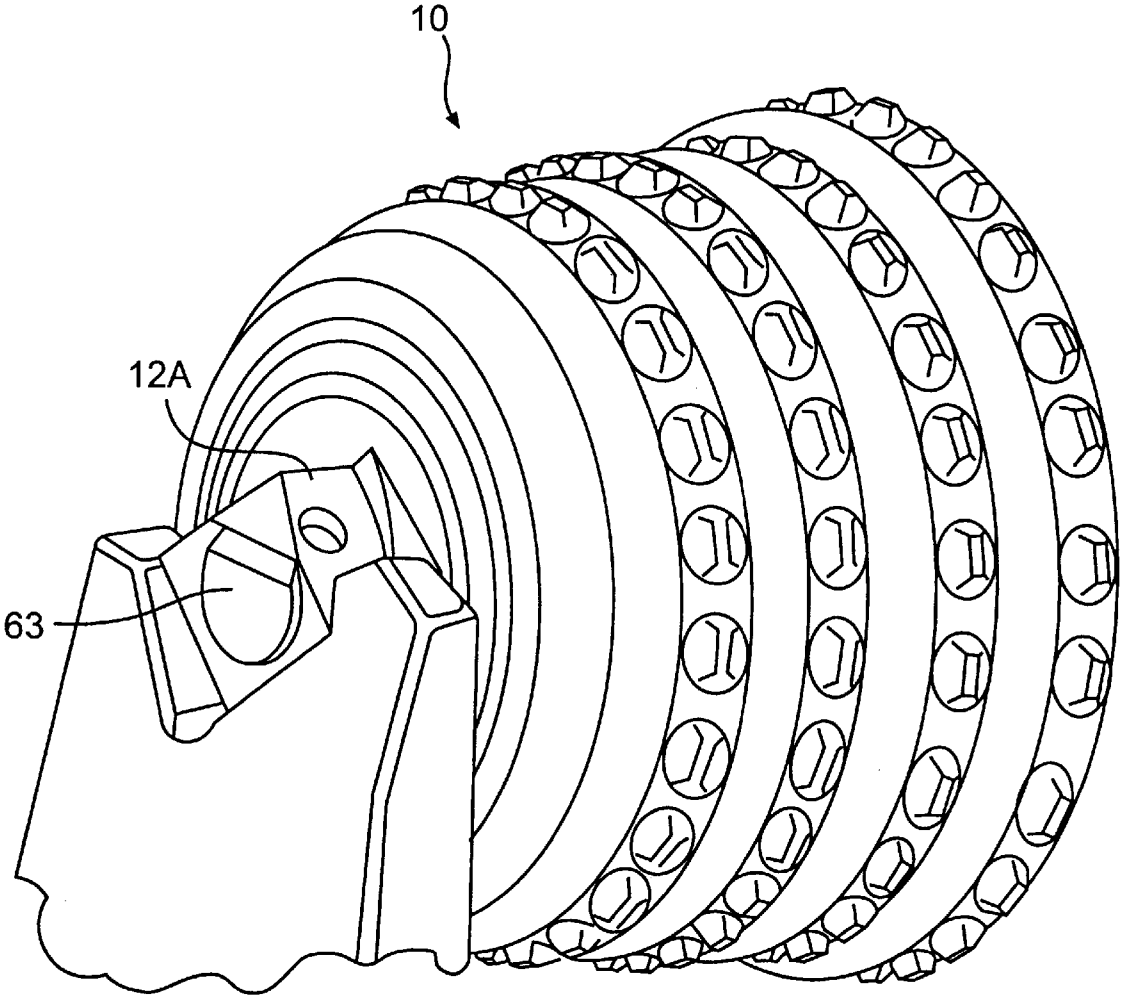
FIG. 5 shows the cutter mounted to a saddle in a perspective view.

The cutter 10 is mounted in the following way. After the expansion plug 52 has been secured in the bore 38 by the snap ring 54, the shank 63 of the cap 62 carrying the O-ring 73 is inserted into the first portion 38A of the bore 38. When the O-ring reaches the bore 38 it will be compressed due to the diameter difference between the bore 38 and the first portion 38A. In that position it is suitable to generally position the first hole 66 with respect to the second hole 71 whereafter the cap is pushed further a distance inwardly by hand until the rear surface 72 of the flange engages the front surface of the saddle end 12A. Said distance is larger than the above-mentioned gap. Now the first hole 66 is really aligned with the second hole 71 so that the screw 70 can be inserted therethrough and can be tightened. The mounted position of the cap 62 is illustrated also in FIG. 5.

The device according to the present invention functions in the following way. When a cutter 10 is set under working conditions it rotates and is subjected to heavy loads. This means that due to friction heat is generated in the bearing means 18,20 and the locking means 26 of the cutter 10 and consequently also the grease is heated. When the grease is heated it expands and since the seal retainers 32 prevent grease from leaking out between the hub 16 and the shaft 12, the grease enters into the expansion space 57. If the grease expands to such an extent that the space 57 becomes completely filled with grease then there is a possibility for the grease to emit through the relief valves 58 and the recesses 60, 61 and 65 and further through the gap between the screw 70 and the hole 71. The grease preferably exits to the outside in direction towards a nut 74 under the saddle end 12A. A serrated washer 75 provides for channels to the outside for the expanding grease. However, under normal conditions the expansion space 57 should be sufficient to accommodate the expansion of the grease. This arrangement will effectively prevent cuttings/dirt to clog the pressure relief valves 58 and the bore 38A.

I claim:

1. A cutter for a boring head, comprising:

a shaft, said cutter being rotatable about a center axis and mounted, via said shaft, in a saddle secured to the boring head, said shaft having ends being secured to the saddle by a fastening means, bearing means provided between the shaft and a hub of the cutter such that the hub rotates relative to the shaft, sealing means between the shaft and the hub, and bore means for introducing a lubrication means into an interior of the cutter, an expansion plug mounted in said bore means, said expansion plug being designed to accommodate the lubrication means that enters into said bore means from the bearing means, and a stopper means provided in the bore means;

wherein said stopper means encases a part of the fastening means and is arranged to prevent mud from entering an orifice of the bore means.

2. A cutter according to claim 1, wherein said stopper means forms an intermediate part of a channel promoting expanding grease.

3. A cutter according to claim 1, wherein said fastening means has a second diameter which is smaller than a first diameter of a first hole of the stopper means and a diameter of a second hole in the saddle so as to create a gap therebetween, said gap providing a grease channel towards an exterior of the cutter.

4. A cutter according to claim 3, wherein said expansion plug is provided with a pressure relief valve that via a plurality of recesses communicates with said gap.

5. A cutter according to claim 1, wherein said stopper means has a generally cylindrical shank portion and a flange portion, said shank portion having a through-going first hole which traverses the stopper means substantially perpendicular to the center axis, said first hole receiving the fastening means.

6. A cutter according to claim 1, wherein said stopper means comprises an O-ring being compressed when mounted in the bore means.

7. A stopper means intended to be centrally mounted in a cutter for a boring head having bore means, said stopper means comprising:

a generally cylindrical shank portion and a flange portion, said shank portion having a through-going first hole which traverses the stopper means substantially perpendicular to a center axis of the stopper means, said stopper means being arranged for preventing mud from entering an orifice of the bore means, wherein said flange portion defines an axial stop surface for engaging a front end of the cutter.

8. A stopper means according to claim 7, wherein said stopper means comprises an O-ring mounted in an external groove.

9. A stopper means according to claim 8, wherein a center line of the through-going first hole of said stopper means extends eccentrically relative to the center axis of the stopper means.

10. A method of preventing mud from contaminating an interior of a cutter for a boring head, said method comprising:

rotatably mounting the cutter about a center axis, via a shaft of the cutter, in a saddle secured to the boring head, said shaft having at least one end secured to the saddle by fastening means, providing bore means for introducing lubrication means into the interior of the cutter, said bore means including an orifice, mounting an expansion plug in said bore means, said expansion plug being designed to accommodate lubrication means that enters into said bore means from bearing means, and pushing a stopper means provided with an external O-ring into said bore means and compressing the O-ring generally simultaneously with covering the orifice of the bore means; and fastening the at least one shaft end to the saddle by the fastening means while generally simultaneously locking the stopper means in a correct position.

* * * * *